United States Patent [19]

Simon

[11] Patent Number: 4,493,521

[45] Date of Patent: Jan. 15, 1985

[54] CONNECTOR HOLDER ASSEMBLY

[75] Inventor: James F. Simon, Portsmouth, R.I.

[73] Assignee: Raytheon Company, Lexington, Mass.

[21] Appl. No.: 453,400

[22] Filed: Dec. 27, 1982

[51] Int. Cl.[3] ..... H01R 13/621

[52] U.S. Cl. ..... 339/92 M; 339/210 M

[58] Field of Search ..... 339/92 R, 92 M, 136 M, 339/141, 210 R, 210 M

[56] References Cited

U.S. PATENT DOCUMENTS

| | | | |
|---|---|---|---|
| 3,054,081 | 9/1962 | Bertram et al. | 339/141 |
| 3,213,406 | 10/1965 | Just et al. | 339/136 M |
| 3,662,321 | 5/1972 | Bury | 339/92 M |
| 4,398,780 | 8/1983 | Novotny et al. | 339/92 M |

FOREIGN PATENT DOCUMENTS

| | | | |
|---|---|---|---|
| 1447412 | 6/1966 | France | 339/92 M |
| 6716527 | 6/1968 | Netherlands | 339/92 M |
| 2088150 | 6/1982 | United Kingdom | 339/92 M |

*Primary Examiner*—John McQuade

*Attorney, Agent, or Firm*—Martin M Santa; Joseph D. Pannone; Richard M. Sharkansky

[57] ABSTRACT

A connector holder assembly for use with a wiring harness wiring has a frame adapted to hold a connector contained with the frame by a snap-on cover. A pair of jackscrews secures the frame to a mating connector. The frame is cast with two arms at each end of a back plate. The arms have inboard slots for receiving jackscrews. The jackscrews are retained within the slots by a connector which has detents at its ends which engage the jackscrews when the connector has been positioned between the jackscrews. A stiff spring-like metallic retainer cover for the connector which is snap fastened to the arms of the frame retains the connector between the frame arms and against the backplate of the frame against the force produced on the connector by the wiring harness attached thereto.

11 Claims, 3 Drawing Figures

CONNECTOR HOLDER ASSEMBLY

BACKGROUND OF THE INVENTION

This invention relates to electric connector holder assemblies which are used to connect a wiring harness to a mating connector mounted at the back end of a slotted cardguide. The depth of the slots of the guide is determined by the corresponding dimension of the electronic modules which occupy other slots of the guide and which mate with their corresponding electrical connectors. With the recent increase in size of the standard module size which requires a corresponding increase in the depth of the slots of the guide; and, with the increase in the number of pins of the connector of the module and its mating connector, the previously used connector holder assembly became inadequate. The deeper slots of the newer slotted card guides made the prior manual insertion of the holder assembly and its extraction with an extracting tool more difficult. Further, the greater number of wires contained within the connector holder assembly resulted in a stiffer wire harness which caused the connector to come loose from its mating connector if the wire harness were flexed, which flexure occurred in normal operation.

It is therefore an object of the invention to provide an improved connector holder assembly which does not suffer from the deficiencies of the prior art holder assemblies.

It is a further object of the invention to provide a connector holder assembly which is economical to manufacture and whose assembly can be accomplished quickly and easily.

It is a further object of the invention to provide a connector holder assembly which is easily inserted and removed from its mating connector and which is securely retained in its mating connector against the extraction force produced by flexing of the harness of wires to which its connector is attached.

It is a feature of the invention that the holder is assembled without requiring screws in the assembly process thereby contributing to the ease and quickness of assembly.

It is a further feature of the invention that jack screws are used to insert, remove, and secure the connector holder assembly to its mating connector.

SUMMARY OF THE INVENTION

The aforementioned objects and features of the invention are provided by a connector holder assembly which has a frame adapted to hold a connector contained within the frame by a snap-on cover. A pair of jack screws secures the frame to a mating connector. The frame is cast with two arms at each end of a back plate. The arms have inboard slots for receiving jack screws. The jack screws are retained within the slots by a connector which has detents at its ends which engage the jack screws when the connector has been positioned between the jack screws. A stiff spring-like metallic cover for the connector which is snap fastened to the arms of the frame secures the connector between the frame arms and against the backplate of the frame against the force produced on the connector by the cable attached thereto.

BRIEF DESCRIPTION OF THE DRAWINGS

The foregoing aspects and features of the invention are explained in the following description taken in conjunction with the accompanying drawings, wherein.

DESCRIPTION OF THE PREFERRED EMBODIMENT

Figure 1:
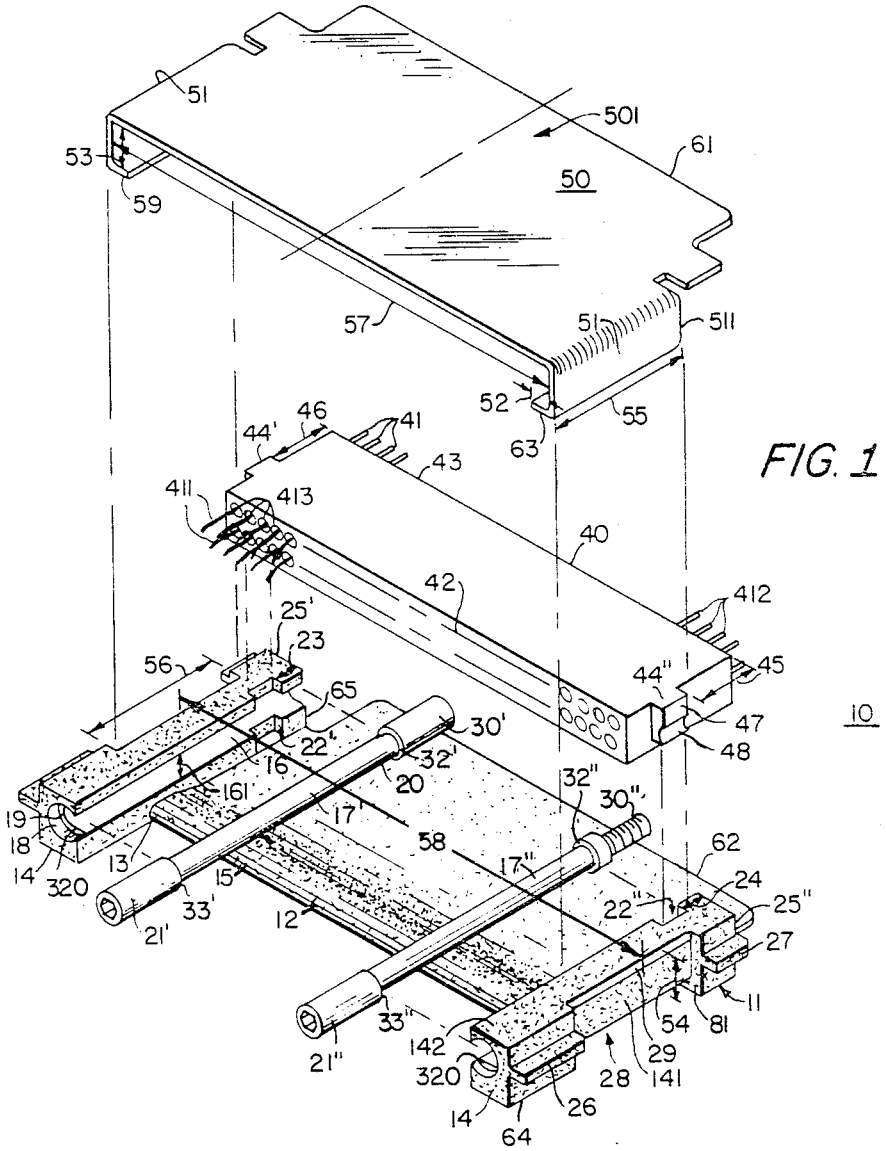
FIG. 1 is an exploded view of the connector holder assembly of the invention.

Referring now to FIG. 1, there is shown an exploded view of the connector holder assembly 10 of this invention. The assembly 10 comprises a cast frame 11, jackscrews 17', 17'', a connector 40 and a cover 50. The frame 11 has a back plate portion 12 integrally formed at its ends 13 with arms 14. The backing plate 12 has a thicker portion 15 to provide greater resistance to bending of the back plate. The arms 14 have a longitudinal slot 16 adapted to accept one of the jackscrews 17', 17''. The arms 14 have at one end a recess 18 concentric with the semi-circular end portion 19 of slot 16. Slot 16 has a slightly larger width 161 than the diameter of the central portion 20 of the jackscrews 17', 17''. The recess 18 has a shoulder 320 which has a diameter which is slightly larger than the diameter of the hexheads 21', 21'' (tool engaging end) of the jackscrews 17', 17''. The other ends 25', 25'' of the arms 14 have transverse slots 22', 22'' which are at different distances 23, 24 from the ends 25', 25''. The arms 14 are provided with guides 26, 27 separated by the longitudinal recess 28. Each arm 14 has a bevel 29 which extends longitudinally along the recess 28 at the corner of the upper 142 and outside 141 surfaces of arm 14.

The jackscrews 17' 17'' have, at their ends opposite that of the hexheads 21', 21'', a threaded end portion which, for jack screw 17', is an internally threaded portion 30', and an externally threaded portion 30'' for jackscrew 17''. The end portion 30', 30'' has a diameter greater than the width 161 of the slot 16 so that the resultant shoulders 32', 32'' of end portion 30', 30'' prevents the jackscrews 17', 17'' from moving in one longitudinal direction along the slot 16. Movement in the opposite longitudinal direction in the slot 16 is prevented by the shoulders 33', 33'' of the jackscrews 17', 17'' where the hexheads portion 21', 21'' meets the cylindrical portion 20.

A connector 40 has connector pins 41 extending from face 42 to face 43. The female ends 413 of the pins 41 at the face 42 receive wires 411 of a cable harness by insertion of the wires 411 and crimping. The connector pins 41 are adapted to be inserted into and through connector 40 to provide male connector pin ends 412 at face 43 as shown in the figures. The connector 40 has projections 44', 44'' at its ends which are at different distances 45, 46 from the face 43. The difference in the dimensions 45, 46 is equal to the difference in the distances 23, 24 of the slots 22', 22'' from the ends 25', 25''. The projections 44', 44'' have a flat portion 47 and a semi-circular portion 48. The portion 48 has the same radius as the central cylindrical section 20 of jackscrews 17', 17''.

A cover 50 is made of a stiff but flexible material having spring-like characteristics. As an example, a suitable material is 0.020 inches thick (stock size) beryllium-copper, alloy 172 one-quarter hard, which after fabrication is heat-treated to a tensile strength of 150,000–160,000 psi. The cover 50 has a planar central portion 501 and transverse "L"-shaped ends 51 whose depth 53 is slightly greater than the thickness 54 of recessed portion 541 of the arm 11. The width 55 of the end 51 is slightly less than the length 56 of the recess 28 of arm 11. The length 57 of cover 50 is slightly greater than the length dimension 58 of the frame 11 at the recess 28. The thickness 54 of arm 14 at its outermost or outside surface 141 is less than depth 53 of the end 51 of cover 50 by at least the thickness of the cover 50. The reentrant end portion 59 of the L-shaped portion 52 extends inwardly toward the center of the cover 50 a lesser distance 52 than the distance 60 to which the recess 281 extends at the bottom surface 64 of arm 14 at recess 28. A portion 61 of cover 50 extends out beyond the connector 40 coextensively with the end region 62 of frame 11 to protect the extended male pins 412 of a connector 40.

Figure 2:
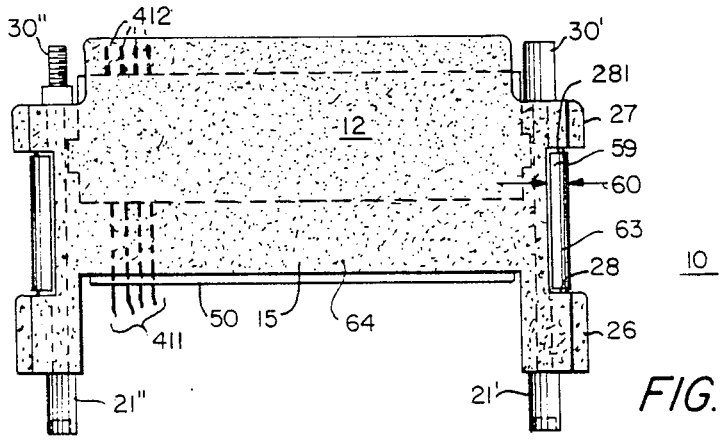
FIGS. 2 and 3 show a bottom plan view and a partial cut-away top isometric view of the assembled holder of the invention.
Figure 3:
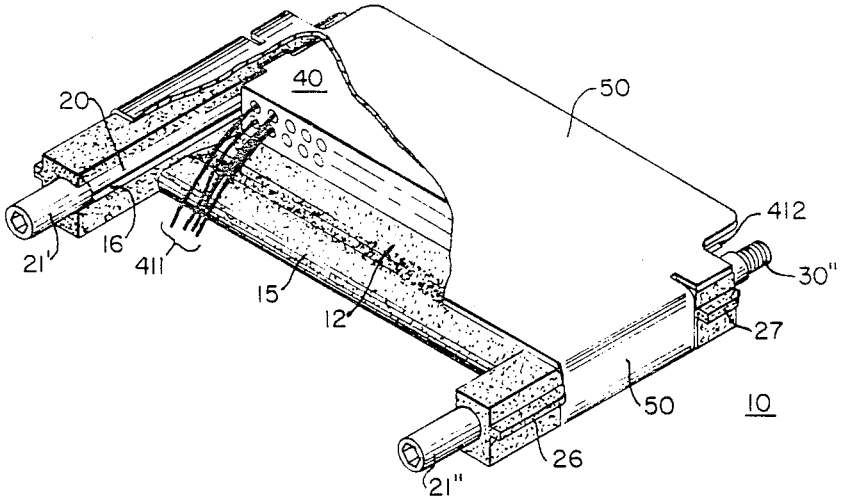

FIGS. 2 and 3 show a plan view and an isometric view in partial cross section, respectively, of the connector holder 10 as assembled from the components shown in the exploded view of FIG. 1. FIG. 2 shows the recess 281 into which the inwardly projecting lip portion 59 of the cover 50 extends. The outer surface 63 of lip 59 is flush or slightly recessed with respect to the bottom surface 64 of the arm 14 and frame 11.

The assembly of connector holder 10 shown in FIGS. 2 and 3 is described by reference to the component parts shown in FIG. 1. The jackscrews 17', 17" are placed in the slots 16 of the arms by first inserting the hexheads 21', 21" of the screws into the recess 18 until the shoulders 33', 33" rest upon the shoulders 320. The length of the reduced diameter portion 20 of the jackscrews 17', 17" is of sufficient length to cause the shoulders 32', 32" of the threaded ends 30', 30" to clear the end corner 65 of the arm 14. The width of the slot 16 is uniform between the shoulder 320 and the end 25' of the arm 14. The width 161 of the slot 16 in this region is greater than that of the diameter 20 of the jackscrew and less than that of the diameter of the threaded portions 30', 30" and hexheads 21', 21" of the jackscrews 17', 17". The diameter and depth of the recess 18 being sufficiently large and shallow, respectively, relative to the diameter of the heads 21', 21" of the jackscrews 17', 17" to allow the jackscrew to be inserted in the longitudinal slot 16 by the steps of first inserting heads 21', 21" into recess 18 before sliding the central portion 20 and of the jackscrews 17', 17" into the longitudinal slot 16. After the jackscrews have been inserted into the slots 16, they are maintained in the slots by the insertion of connector 40 between the jackscrews. The projections 44', 44" of connector 40 enter the slots 22', 22", respectively, with the semicircular, grooved, or U-shaped portion 48 preceding the flat portion 47 of the projections 44', 44". The length of the connector including the U-shaped portions 48 of each projection 44', 44" is slightly less than the separation between the jackscrews 17', 17" at their diameter portions 20, so that the insertion under slight pressure of the connector projections 44', 44" in the slots 22', 22" causes the U-shaped portion 48 to snap around the jackscrew diameter 20 to maintain the connector 40 in contact with the jackscrews at the back plate 12 without further external force being applied to the connector. The insertion of the connector 40 also prevents the jackscrews 17', 17" near ends 30', 30" from falling out of the slot 16 by movement in a direction parallel to the back plate 12. The recessed portion 18 prevents the hexheads 21', 21" of the jackscrews 17', 17" from moving in that same plane. Lengthwise movement of the jackscrews 17', 17" is limited by the diameters of the ends 21', 21", 30' of each jackscrew being larger than the width 161 of the slot 16. After the connector has been secured against the plate 12 by the engagement of U-shaped portion 48 with the jackscrews 17', 17", the cover 50 is applied by snapping the cover over the arms 14 in the recess 28 to thereby cause the inwardly projecting or reentrant portion 59 of cover 61 to occupy recess 60 of arm 14 at recess 28 as shown in FIG. 2. The bevelled edge 29 of the arm 14 makes it easier for the inwardly extending portions 59 of cover 50 to slide over the arm 14 for engagement therewith. The secured cover 50, parallel to back plate 12, prevents lateral forces on the connector 40, such as would be produced by the wires 411 when utilizing the connector assembly, from disengaging the connector from the jackscrews. The frictional force produced by the U-shaped portion 48 upon the jackscrews is merely sufficient to retain connector 40 during the assembly process outlined above, but insufficient to resist the forces produced by the connector wires 411 when utilizing the connector assembly. The jackscrews are used to insert, remove, and secure the connector holder assembly 10 to a mating connector (not shown) having mating screws.

Instead of the L-shaped end configuration 51 of the cover 50 shown in the figures, it will be apparent to those skilled in the art that other forms of end-locking configurations would also be suitable to provide sufficient retention strength of the cover on the frame 11 to prevent unintentional release during use of the connector 40. As an example, the end 51 could be V-shaped detent extending in the dimension 55 direction with a corresponding V-shaped longitudinal projection or depression in the end face 141 of arm 14. The V-shaped ends embodiment of the cover 50 would snap onto the arms 14 in much the same manner as the L-shaped ends 51 envelope the arms 14 as in the preferred embodiment.

Having described a preferred embodiment of the invention, it will now be apparent to one of skill in the art that other embodiments incorporating its concept may be used. It is felt, therefore, that this invention should not be limited to the disclosed embodiment, but rather should be limited only by the spirit and scope of the appended claims.

What is claimed is:

1. An electrical connector holder assembly comprising:

a frame comprising a continuous back plate and a first and second arm, each arm attached to an opposite end of said back plate and forming a recess therewith;

a first and second jackscrew extending through said first and second arms, respectively;

means for rotatably mounting said first and second jackscrew to said first and second arm, respectively;

a connector;

said mounting means comprising said connector positioned in said recess between and in contact with said jackscrews and adjacent to said back plate;

a removable cover for said connector on the opposite side of said connector from said back plate to retain said connector within said recess;

said cover being flexible but stiff and engaging said arms to retain said connector within the recess of said frame.

2. The holder assembly of claim 1 wherein:

each of said first and second arms has a longitudinal slot; and each of said jackscrews having means for engaging said slot to prevent longitudinal movement of said jackscrews in each of said arms.

3. The holder assembly of claim 1 wherein:

each of said arms has a longitudinal open slot having its opening facing said recess; and each of said jackscrews has a portion of diameter smaller than the width of said slot inserted in said slot, each jackscrew having the diameter of its ends outside said slot greater than the width of said slot to prevent longitudinal movement of said jackscrew in said slot.

4. The holder assembly of claim 1 wherein:

said connector has a longitudinally extending projection at each end;

each of said arms having a recess into which each said connector projection extends thereby preventing longitudinal movement of said connector with respect to said arms;

each of said projections having a semicircular portion engaging a jackscrew thereby retaining said connector within the arms of said frame.

5. The holder assembly of claim 1 wherein:

said cover has end pieces which are at right angles to the central portion of said cover;

said end pieces having a detent;

each said arms having an outside surface having a mating detent;

said cover and arm detents being in engagement to retain said cover on said frame to prevent dislodgement of said connector.

6. The holder assembly of claim 5 wherein:

each said cover end piece detent comprises said right angle piece having a further right angle extension to thereby form an "L-shaped" end piece, said "L-shaped" end piece of said cover extending around said arms to secure said cover to said frame.

7. The assembly of claim 6 wherein:

each of said arms has a bevelled portion, said bevelled portion facilitating the engagement of said cover with said arms; and said bevelled portion being on the corner formed by the outermost surface of said arm and the surface of said arm nearest said cover.

8. The assembly of claim 6 wherein:

each of said arms are recessed on its outermost surface and on its surface furthermost from said cover to result in the L-shaped portion of said cover being flush with said outermost and furthermost surfaces.

9. An electrical connector assembly comprising:

a frame comprising a continuous back plate and a first and second arm attached to said plate at its opposite ends to form a first recess in said frame;

a pair of jackscrews, each having a threaded end and a tool engaging end;

each of said first and second arms having a slot facing said first recess which extends longitudinally along the length of each arm;

each jackscrew being cylindrical with a central cylindrical portion of smaller diameter than its threaded and its tool engaging ends;

said central cylindrical portion of each jackscrew being inserted within said slot;

the length of each slot in each arm being substantially the same length as the length of the central portion of each jackscrew;

an electrical connector between each jackscrew and in frictional engagement therewith;

at least one of said arms having a second recess;

said connector being in engagement with said second recess in at least one of said arms to prevent relative longitudinal movement of said connector with respect to said arms;

a stiff but flexible cover in locking engagement with the arms of said frame;

said cover holding said connector between said jackscrews and within said first recess of said frame.

10. The holder assembly of claim 9 wherein:

each of said first and second arms has a cylindrical recess at one end of each arm, each cylindrical recess being of a depth and diameter to receive one end of each jackscrew;

each longitudinally extending slot of each arm terminating in a semicircular surface; and the axes of said semicircular surface and said cylindrical recess being coincident.

11. The assembly of claim 9 wherein:

said arms have their outermost surfaces recessed over a portion of said outermost surface;

said cover having a central portion thereof in a plane parallel to said back plate;

said cover having its ends formed to provide "L"-shaped portions, one portion of said "L" being transverse to said central portion of said cover, the end portion of said "L" being parallel to said central portion of said cover, said "L"-shaped portions and said central portion of said cover forming a reentrant portion of said cover; and said "L"-shaped portion of said cover engaging said arms at their recessed outermost surfaces.

* * * * *